US005646363A

United States Patent [19]

Denchfield

[11] Patent Number: 5,646,363

[45] Date of Patent: Jul. 8, 1997

[54] FREE PISTON MACHINE

[75] Inventor: Clifford Denchfield, Ellington, United Kingdom

[73] Assignee: Loral Europe Limited, Hoddesdon, Great Britain

[21] Appl. No.: 420,305

[22] Filed: Apr. 10, 1995

[30] Foreign Application Priority Data

Apr. 9, 1994 [GB] United Kingdom ..... 9407067

[51] Int. Cl.[6] ..... F41A 33/04

[52] U.S. Cl. ..... 89/7; 89/1.14

[58] Field of Search ..... 89/1.2, 7, 1.14; 181/116, 117, 401; 102/200; 73/12.08; 434/16, 18

[56] References Cited

U.S. PATENT DOCUMENTS

| | | | |
|---|---|---|---|
| 3,214,909 | 11/1965 | Gordon | 89/7 |
| 3,215,223 | 11/1965 | Kirby et al. | 181/117 |
| 3,238,642 | 3/1966 | Ohlund | 434/16 |
| 3,323,531 | 6/1967 | Spellman | 137/68 |
| 4,100,991 | 7/1978 | Airhart | 181/117 |
| 4,284,164 | 8/1981 | Airhart | 181/117 |
| 4,712,379 | 12/1987 | Adams et al. | 60/632 |
| 5,180,878 | 1/1993 | Denchfield | 89/7 |

FOREIGN PATENT DOCUMENTS

| | | | |
|---|---|---|---|
| 2441748 | 6/1980 | France . | |
| 760010 | 8/1980 | U.S.S.R. | 181/117 |
| 753924 | 8/1956 | United Kingdom . | |
| 2027200 | 2/1980 | United Kingdom | 181/117 |
| WO8303893 | 11/1983 | WIPO . | |

OTHER PUBLICATIONS

Seisakusho et al., Abstract Only for Japan 59–221401, Apr. 27, 1985.

European Search Report for EPO Application 95 30 2344.

*Primary Examiner*—Stephen M. Johnson
*Attorney, Agent, or Firm*—Christie, Parker & Hale, LLP

[57] ABSTRACT

A free piston machine comprising a cylinder having a first and second closed ends, a piston slidable in the cylinder between the closed ends, a first conduit communicating between a source of gas under pressure and the first closed end of the cylinder, a second conduit communicating between the first closed end of the cylinder and atmosphere, valve means controlling flow through the second conduit, and a piston-controlled port in the cylinder and communicating between the cylinder and the source of gas under pressure, the arrangement being such that the piston closes the port when disposed at the first closed end of the cylinder.

12 Claims, 1 Drawing Sheet

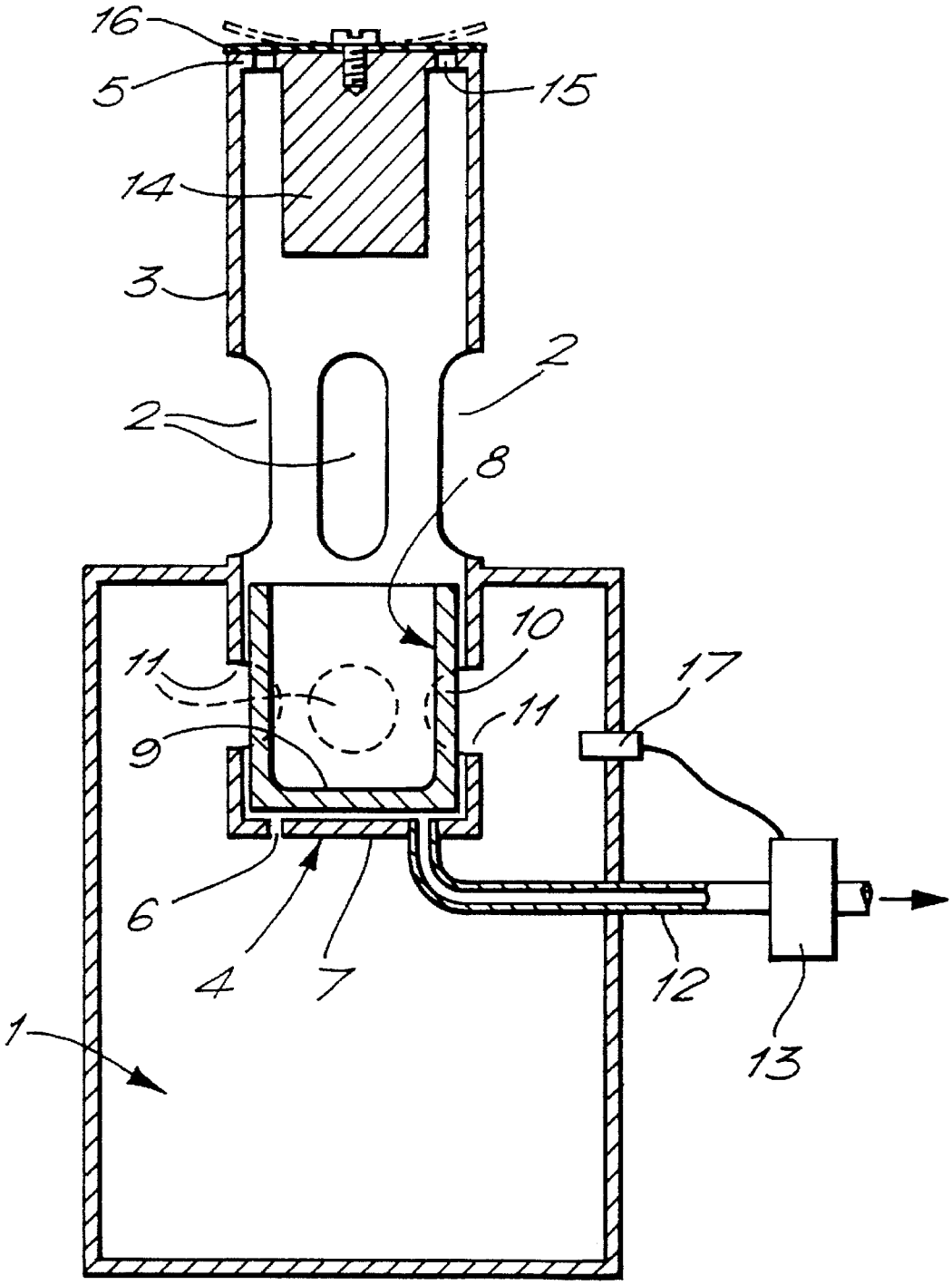
16
5
15
14
3
2
2
8
10
11
11
17
9
6
4
7
12
13
1

FREE PISTON MACHINE

The invention relates to a free piston machine for use more particularly, but not exclusively, as a sound generator to simulate the sound of gunfire.

It is known from U.S. Pat. No. 5,180,878 to provide a gunfire simulator comprising a combustion chamber, means for admitting fuel gas to the combustion chamber, a flap valve for admitting air to the combustion chamber, means to force ambient air into the combustion chamber through the flap valve, ignition means for igniting fuel gas in the combustion chamber to cause an explosion, an exhaust port in the combustion chamber and outlet valve means for closing the exhaust port and arranged to open rapidly and with audible result in response to explosive pressure rise within the combustion chamber, the outlet valve means being in the form of a frangible diaphragm of thin sheet material.

It is an object of the invention to provide a gunfire simulator having a novel rapidly opening outlet valve closing an exhaust port.

It is a further object of the invention to provide a gunfire simulator having a novel rapidly opening outlet valve closing an exhaust port which obviates the need for a frangible diaphragm which must be replaced each time the simulator is used.

According to the invention there is provided a free piston machine comprising a cylinder having a first closed end portion, a piston slidable in the cylinder, a first conduit communicating between a source of gas under pressure and the first closed end of the cylinder, a second conduit communicating between the first closed end of the cylinder and atmosphere, valve means controlling flow through the second conduit, and a piston-controlled port in the cylinder and communicating between the cylinder and the source of gas under pressure, the arrangement being such that the piston closes the port when disposed at the first closed end of the cylinder. Preferably the first conduit is in the form of one or more bleed holes of small diameter relative to the size of the piston-controlled port. With such an arrangement the piston will remain stationary at the said first closed end of the cylinder while the valve means controlling flow through the second conduit, which is preferably larger in diameter than the diameter of the first conduit, remains open since gas under pressure entering the first closed end of the cylinder through the bleed holes is exhausted to atmosphere through the second conduit. On closing the valve means, the piston will move relatively slowly away from the first closed end of the cylinder under the action of the limited quantity of compressed gas bleeding through the first conduit until the piston-controlled port is uncovered, at which stage a large volume of compressed gas will enter the cylinder and will cause the piston to move rapidly along the cylinder.

The piston-controlled port may be disposed adjacent to the first closed end portion of the cylinder.

Means may be provided at the other end of the cylinder for arresting the piston. The piston-arresting means may comprise a second closed end portion of the cylinder arranged in association with the piston to form an air cushion. Preferably the air cushion in the second closed end portion of the cylinder comprises one-way valve means vented to atmosphere to control, reduce or prevent bouncing of the piston at the second closed end of the cylinder.

The arrangement may be such that the cylinder is disposed substantially vertically with the second closed end uppermost, in which case the piston may return to the first closed end under gravity. Alternatively resilient means, e.g. a spring, may be provided for returning the piston to the said first closed end of the cylinder.

The source of gas under pressure may be provided by a closed combustion chamber fed with a mixture of fuel gas, e.g. propane, and air and ignited by spark ignition apparatus. The valve means controlling the second conduit may be arranged to close in response to a predetermined degree of pressure rise in the combustion chamber. Preferably the cylinder is arranged to project into the combustion chamber such that the end of the cylinder including said cylinder port is disposed in the chamber.

The cylinder may comprise an exhaust port disposed axially beyond said first port in comparison to said first closed end, said exhaust port being outside the combustion chamber and open to atmosphere. Such an arrangement permits rapid expulsion of the compressed gas to atmosphere when the exhaust port is uncovered by movement of the piston and can be used as a sound generator e.g. as a bird-scarer or to simulate the sound of gunfire.

The invention is diagrammatically illustrated by way of example in the accompanying drawing which is a cross-sectional view of a free piston machine intended as a gunfire simulator.

In the drawing, a gunfire simulator of the kind generally described in U.S. Pat. No. 5,180,878 is shown, but in the present case the exhaust system is in the form of a free piston device.

The simulator comprises a generally cylindrical combustion chamber 1 vented to atmosphere through a radial series of piston-controlled exhaust ports 2. The exhaust system comprises a cylinder 3 having an opposed pair of closed ends 4 and 5 respectively, the end 4 projecting into the combustion chamber 1. The cylinder end 4 in the combustion chamber is formed with one or more small bleed holes 6 in its axial end 7 which communicate between the interior of the combustion chamber and the interior of the cylinder. A piston 8 is freely slidable in the cylinder 3 with its head 9 towards the combustion chamber and with a cylindrical skirt 10 of sufficient axial length to cover a radial array of transfer ports 11 in the curved surface of the cylinder adjacent to the end 4 and which communicate between the combustion chamber interior and the interior of the cylinder.

The interior of the end 4 of the cylinder is vented to atmosphere via a conduit 12 which is of greater cross-sectional area than that of the bleed holes. Flow through the conduit is controlled by a normally open solenoid valve 13 which is linked to a pressure sensor 17 in the combustion chamber such that the valve is closed in response to a predetermined degree of pressure rise in the combustion chamber. Thus the valve may be arranged to close when the pressure in the chamber approaches its maximum value, typically around 9 bars.

Externally of the combustion chamber, the cylinder is formed with a radial series of exhaust ports 2 which are uncovered when the piston 8 moves towards the outer end 5 of the cylinder.

At the outer end 5 of the cylinder there is formed a piston arresting mechanism formed by the closed end 5 of the cylinder and comprising a plug 14 which reduces the dead volume between the piston skirt and the cylinder and as the piston approaches the outer end of the cylinder so that an air cushion is created. To prevent or reduce the piston from bouncing off the air cushion the outer end of the cylinder is vented to atmosphere via small ports 15 formed in the axial end of the cylinder and covered by a flexible diaphragm 16 which forms a one way valve which closes in response to a pressure drop at the outer end of the cylinder caused by the piston bouncing away from the cylinder end 5. The diaphragm is shown dotted in its open position and in full in its position closing the parts 15. Thus the piston arresting and damping is effective in both directions of piston travel.

The operation of the simulator is as follows:

1. Combustion of a gas charge in the combustion chamber 1 raises the pressure therein to around 9 bars.
2. The piston 8 remains stationary in the cylinder 3 during this pressure rise due to port(s) 11 being closed, and since the combustion gases entering the cylinder through the bleed hole 6 exits to atmosphere through the conduit 12 and normally open solenoid valve 13.
3. When the combustion pressure approaches its maximum value the solenoid valve 13 closes under the influence of the pressure switch 17.
4. Gas entering bleed hole 6 moves the piston 8 slowly away from the cylinder end 4.
5. Port(s) 10 are then uncovered and the piston 8 accelerates rapidly under the action of the combustion peak pressure.
6. Piston travel uncovers the exhaust port(s) 2 producing a supersonic bang from the combustion pressure exhausting to atmosphere.
7. Further piston travel covers the exhaust ports 2 causing a braking effect due to pressure build-up ahead of the piston as it approaches the closed end 5 of the cylinder.
8. The speed of deceleration is controlled by controlled release of pressure through the port(s) 15.
9. Pressure ahead of piston causes the piston 8 to stop and then bounce back causing a vacuum which closes the diaphragm flap valve 16 to damp the piston bounce.
10. The piston returns slowly to the end 4 of cylinder under gravity or by spring means.

The invention thus provides a simple device for use as a gunfire simulator and which can be used repeatedly without the need for frequent maintenance or replacement of parts.

I claim:

1. A gunfire simulator comprising a cylinder having first and second partially closed ends, a free piston slidable in the cylinder between the partially closed ends, a first conduit communicating between a source of gas under pressure and the first partially closed end of the cylinder, a second conduit communicating between the first partially closed end of the cylinder and atmosphere, valve means controlling flow through the second conduit, a piston-controlled port in the cylinder and communicating between the cylinder and the source of gas under pressure, the arrangement being such that the piston closes the port when disposed at the first partially closed end of the cylinder, and an exhaust port in the cylinder located axially between the piston-controlled port and the second partially closed end for rapidly exhausting the gas under pressure to atmosphere to simulate an explosion.

2. A gunfire simulator according to claim 1, comprising at least one bleed hole of small diameter relative to the size of the piston-controlled port and forming the first conduit.

3. A gunfire simulator according to claim 1, wherein the piston-controlled port is disposed adjacent to the first partially closed end of the cylinder.

4. A gunfire simulator according to claim 1, comprising a closed combustion chamber fed with a mixture of fuel gas and air and spark ignition apparatus to ignite the mixture of fuel gas and air to provide the source of gas under pressure.

5. A free piston machine comprising a cylinder having first and second partially closed ends, a piston slidable in the cylinder between the partially closed ends, a first conduit communicating between a source of gas under pressure and the first partially closed end of the cylinder, a second conduit communicating between the first partially closed end of the cylinder and atmosphere, valve means controlling flow through the second conduit, piston arresting means at the second end partially closed of the cylinder to form an air cushion, one-way valve means at the second partially closed end of the cylinder and vented to the atmosphere to damp movement of the piston at the second partially closed end of the cylinder, and a piston-controlled port in the cylinder and communicating between the cylinder and the source of gas under pressure, the arrangement being such that the piston closes the port when disposed at the first partially closed end of the cylinder.

6. A free piston machine according to claim 5, comprising at least one bleed hole of small diameter relative to the size of the piston-controlled port and forming the first conduit.

7. A free piston machine according to claim 5, wherein the piston-controlled port is disposed adjacent to the first partially closed end of the cylinder.

8. A free piston machine comprising a cylinder having first and second partially closed ends, a piston slidable in the cylinder between the partially closed ends, a closed combustion chamber fed with a mixture of fuel gas and air and spark ignition apparatus to ignite the mixture of fuel gas and air to provide a source of gas under pressure, a first conduit communicating between the source of gas under pressure and the first partially closed end of the cylinder, a second conduit communicating between the first partially closed end of the cylinder and atmosphere, valve means controlling flow through the second conduit, means urging said valve means to close in response to a predetermined degree of pressure rise in the combustion chamber, and a piston-controlled port in the cylinder and communicating between the cylinder and the source of gas under pressure, the arrangement being such that the piston closes the port when disposed at the first partially closed end of the cylinder.

9. A free piston machine according to claim 8, wherein the cylinder is arranged to project into the combustion chamber such that the end of the cylinder including the piston-controlled port is disposed in the chamber.

10. A free piston machine according to claim 8, comprising an exhaust port in the cylinder located axially between the piston-controlled port and the second partially closed end, said exhaust port being outside the combustion chamber and open to the atmosphere.

11. A free piston machine according to claim 8 comprising at least one bleed hole of small diameter relative to the size of the piston-controlled port and forming the first conduit.

12. A free piston machine according to claim 8, wherein the piston-controlled port is disposed adjacent to the first partially closed end of the cylinder.

* * * * *